US005613736A

United States Patent [19]

Schaked et al.

[11] Patent Number: 5,613,736

[45] Date of Patent: Mar. 25, 1997

[54] REMOVABLE HEADREST

[76] Inventors: Baruch Schaked; Edgar Schaked; Yaakov Schaked, all of 3530 Mystic Point Dr., Apt. 1401, N. Miami Beach, Fla. 33180

[21] Appl. No.: 504,178

[22] Filed: Jul. 19, 1995

[51] Int. Cl.[6] ..... A47C 1/036; A47C 7/38

[52] U.S. Cl. ..... 297/397; 297/398; 297/404; 297/406; 5/643; 5/922; 128/870

[58] Field of Search ..... 297/391, 397, 297/398, 404, 406; 5/636, 640, 643, 922; 128/870

[56] References Cited

U.S. PATENT DOCUMENTS

| | | | |
|---|---|---|---|
| 2,582,571 | 1/1952 | Thoma . | |
| 2,719,577 | 10/1955 | Eyman | 297/391 |
| 3,578,383 | 5/1971 | Earl | 297/391 |
| 3,608,964 | 9/1971 | Earl | 297/397 |
| 4,154,478 | 5/1979 | Cohune | 297/397 |
| 4,447,922 | 5/1984 | Brochu | 297/391 |
| 5,015,036 | 5/1991 | Fergie | 297/391 |

*Primary Examiner*—Peter M. Cuomo
*Assistant Examiner*—Anthony D. Barfield
*Attorney, Agent, or Firm*—J. Sanchelima

[57] ABSTRACT

A removable headrest device for seats with headrest. The device includes two boards that are joined by an elastic and an non-elastic band that embrace the headrest of the seat, and extend forward a sufficient distance to serve as a support for a user. Velcro pads are used to cooperatively tighten the non-elastic band in order to keep the removable headrest device firmly in place. Advertising or promotional or any other graphic material can be placed in the free areas of the boards. Optimally, protective covers with advertising material are removably inserted on the distal ends of the boards.

6 Claims, 2 Drawing Sheets

REMOVABLE HEADREST

BACKGROUND OF THE INVENTION

1. Field of the Invention.

The present invention relates to removable headrests, and more particularly, to such devices that can be readily disassembled for storage.

2. Description of the Related Art.

Applicant believes that the closest reference corresponds to U.S. Pat. No. 2,582,571 issued to A. M. Thomas in 1950. The patented invention is not volumetrically efficient and constrain the user to one position. Here, a user can readily transport the disassembled headrest. Also, the supporting boards provide sufficient support without constraining a user's movement. The combination of an elastic member with a non-elastic member provides the necessary gripping support.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a head rest device that can be readily installed on the upper portion of the back rest of a seat.

It is another object of this invention to provide a headrest that can be readily disassembled, readily carried and stored.

It is still another object of the present invention to provide a headrest that is volumetrically efficient.

It is another object of the present invention to provide a headrest that includes sufficiently large areas to be used for advertising and promotional purposes.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
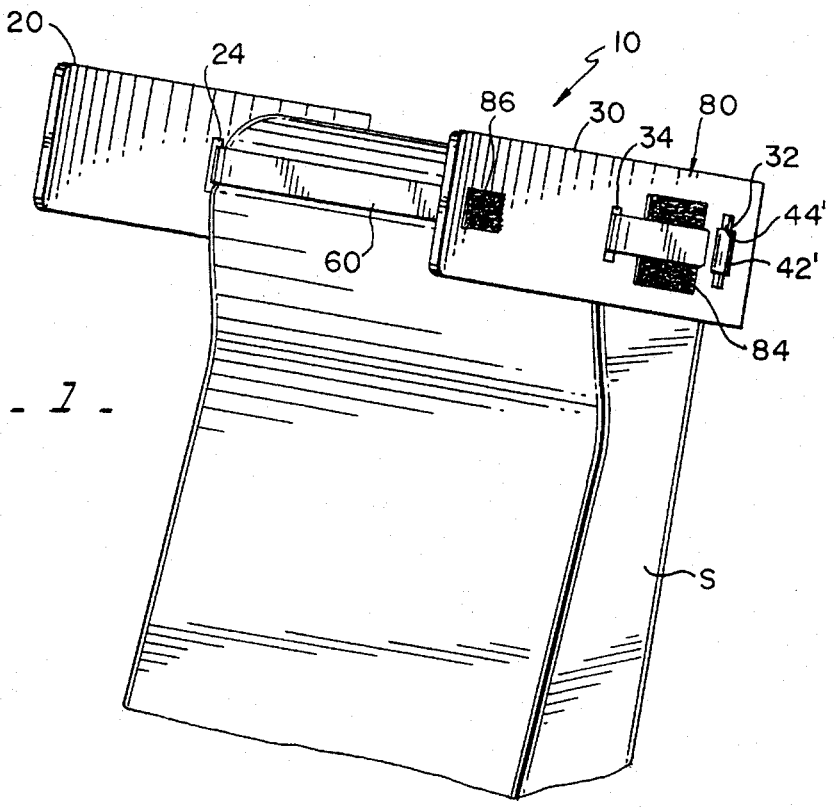
FIG. 1 represents an isometric view of the headrest subject of the present application.
Figure 2:
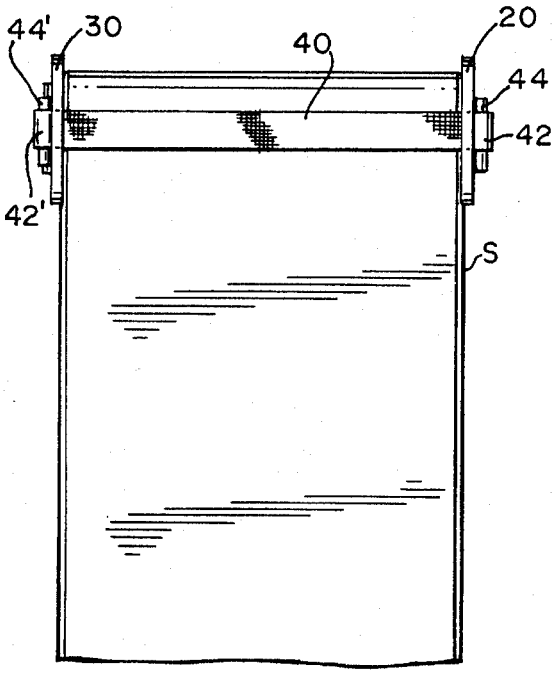
FIG. 2 shows a rear view of the headrest mounted to the upper portion of a seat.

Referring now to the drawings, where the present invention is generally referred to with numeral 10, it can be observed that it basically includes supporting flat members or boards 20 and 30, with elastic band 40, and non-elastic band 60 connecting the former.

Figure 3:
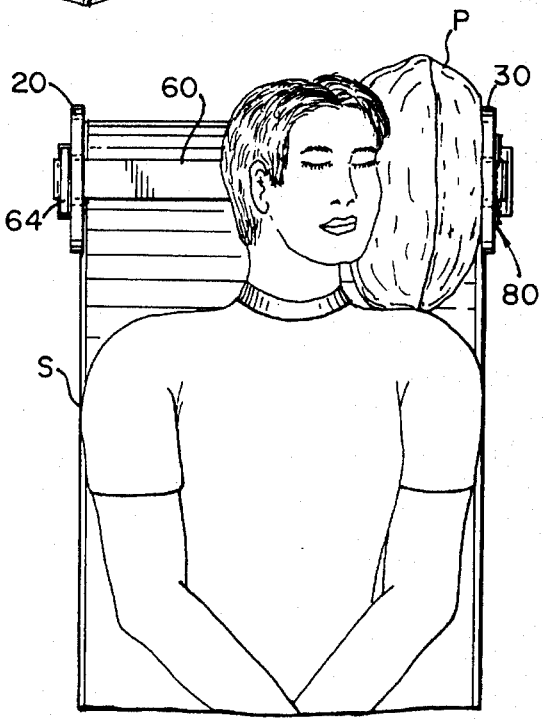
FIG. 3 illustrates a front view of the headrest installed on the upper portion of a seat and a user leaning against one of the support boards.

Board 20, as shown in the drawings, has preferably a rectangular shape and on one half it includes slots 22 and 24 through which bands 40 and 60 pass, respectively. Similarly, board 30 includes slots 32 and 34 through which bands 40 and 60 pass, respectively. In the preferred embodiment, band 40 has loops 42 and 42' at each of its ends, through which pin members 44 and 44' are passed thereby preventing the formers from slipping out. In this manner, and by selecting the length of elastic band 40, a user can stretch it a sufficient distance to place boards 20 and 30 next to the sides of seat S. Non-elastic band 60, in the preferred embodiment, has pin 64 rigidly mounted to one end that prevents band 60 from slipping out. The other distal end of band 60 ends with Velcro pad 82. In this manner, a user can then tighten boards 20 and 30 towards each other, thereby embracing seat S and keeping headrest 10 in place. Boards 20 and 30 extend substantially perpendicularly from seat S a sufficient distance to provide support for a user's head, either directly or through the use of a pillow P, as illustrated in FIG. 3.

Figure 4:
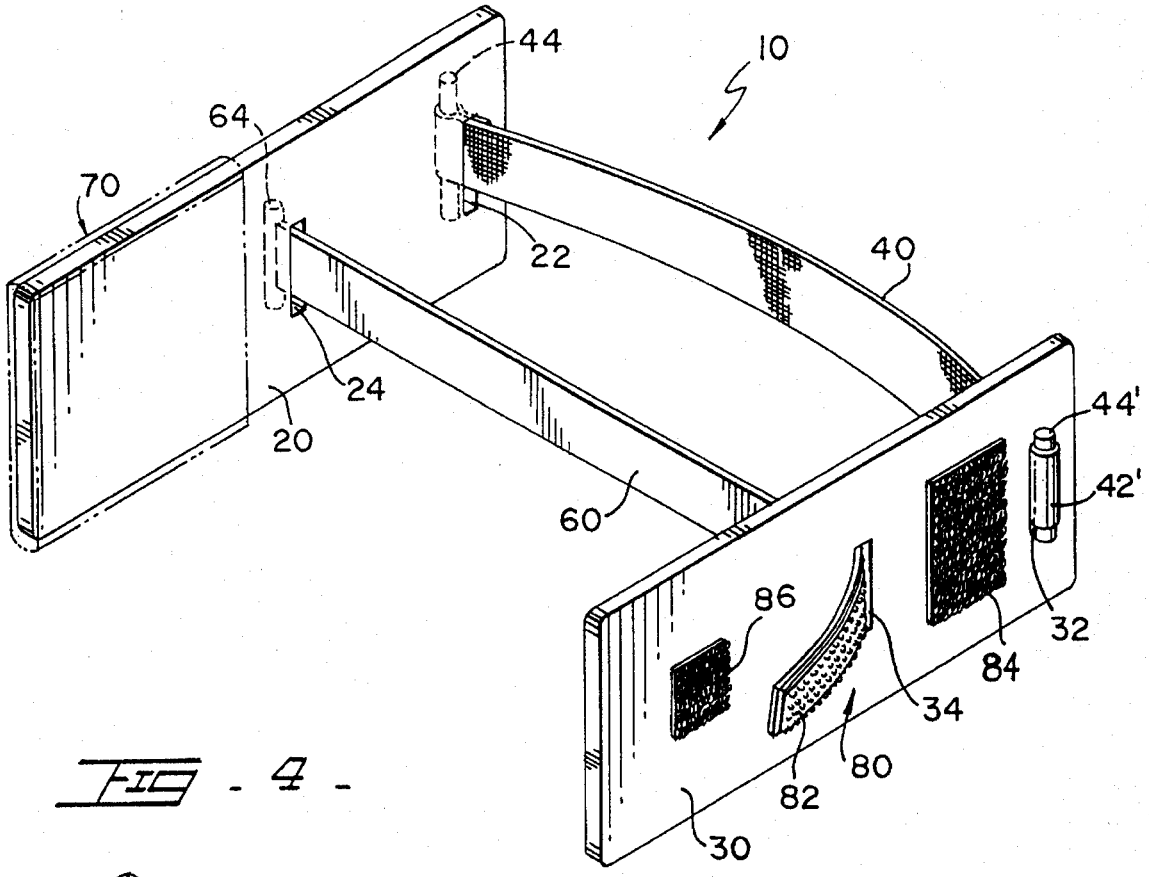
FIG. 4 is an isometric representation of the headrest by itself.

In the preferred embodiment, fastening mechanism 80 corresponds to Velcro pads 82 and 84, as best seen in FIGS. 1 and 4. Velcro pad 82 is located at one of the distal ends of non-elastic band 60. Mating Velcro pad 84 is cooperatively positioned on the outer surface of board 30 to permit a user to tighten band 60 and keep it in place.

When a user decides to store headrest 10, boards 20 and 30 are brought against each other. Elastic band 40 wraps around boards 20 and 30 and non-elastic band 60 wraps around the entire assembly. Board 30 also has mating Velcro pad 86 mounted to board 30. Once headrest assembly 10 is ready to be transported and stored, Velcro pad 82 of band 60 and Velcro pad 86 are fastened, thereby permitting a user the entire assembly to make it easier to transport and store.

Figure 6:
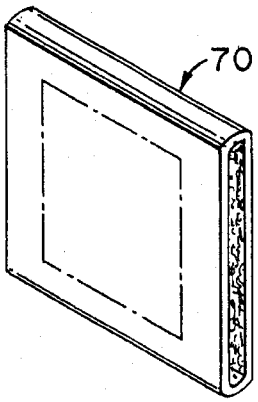
FIG. 6 is an isometric view of a protective cover for supporting boards.
Figure 5:
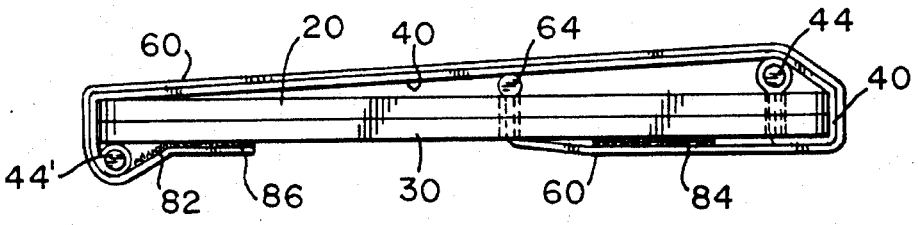
FIG. 5 shows the headrest, disassembled and ready to be stored.

In FIG. 6, protective cover 70 can be removably inserted through the free ends of supporting boards 20 and 30. Cover 70 can be made out of a breathing material such as cloth or paper to prevent a user from sweating. Advertising and/or promotional material can be printed on the outer surface of cover 70, as best seen in FIG. 6. In one of the applications, cover 70 can be impregnated with a fragrance and this may be particularly attractive if the name of the manufacturer is also printed on the cover 70.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A removable headrest device on seats with headrest portions having two end sides, comprising:

A) first and second flat members having each first and second ends and said first ends being positioned adjacent to said sides and said first and second flat members extend substantially perpendicularly from said end sides;

B) elastic means having two ends mounted to said first ends; and

C) non-elastic flexible means having two ends, mounted to said flat members at a position sufficiently separated from said first ends of said flat members which embraces said headrest portion.

2. The device set forth in claim 1, further comprising:

means for locking said non-elastic flexible means to said first flat member.

3. The device set forth in claim 2, further comprising:

protective cover means removably mounted over said second ends of said flat members.

4. The device set forth in claim 3 wherein said means for locking includes cooperative hook and hoop fasteners mounted on said end of said non-elastic flexible means.

5. The device set forth in claim 4, wherein said protective cover means includes promotional material printed thereon.

6. The device set forth in claim 5, wherein said protective cover means contains a fragrance.

* * * * *